US008516942B2

(12) United States Patent
Bouet et al.

(10) Patent No.: US 8,516,942 B2
(45) Date of Patent: Aug. 27, 2013

(54) EXTENSIBLE PROTECTION SYSTEM

(75) Inventors: Thierry Bouet, Orleans (FR); Didier Larousse, La Ferte Saint Aubin (FR); Gilles Boucheron, La Ferte Saint Aubin (FR)

(73) Assignee: TDA Armements S.A.S., La Ferte Saint Aubin (FR)

( * ) Notice: Subject to any disclaimer, the term of this patent is extended or adjusted under 35 U.S.C. 154(b) by 0 days.

(21) Appl. No.: 13/376,028

(22) PCT Filed: Jun. 3, 2010

(86) PCT No.: PCT/EP2010/057756

§ 371 (c)(1),
(2), (4) Date: Jan. 11, 2012

(87) PCT Pub. No.: WO2010/139750

PCT Pub. Date: Dec. 9, 2010

(65) Prior Publication Data

US 2012/0125188 A1 May 24, 2012

(30) Foreign Application Priority Data

Jun. 5, 2009 (FR) ..... 09 02732

(51) Int. Cl.

| | |
|---|---|
| ***B63G 9/00*** | (2006.01) |
| ***C06D 5/00*** | (2006.01) |
| ***F41H 11/02*** | (2006.01) |
| ***F41H 13/00*** | (2006.01) |

(52) U.S. Cl.
USPC ..... 89/36.12; 89/918; 102/531; 114/240 R

(58) Field of Classification Search
USPC ..... 89/36.01, 36.04, 36.07, 36.08, 36.09, 89/36.11, 36.12, 36.17; 102/530, 531; 114/9, 114/14, 240 R, 240 A, 240 B, 240 D
See application file for complete search history.

(56) References Cited

U.S. PATENT DOCUMENTS 1,263,003 A * 4/1918 Thomas ..... 114/240 B
1,324,904 A * 12/1919 Knapp ..... 89/36.12
1,405,294 A * 1/1922 Corsini ..... 114/240 R (Continued)

FOREIGN PATENT DOCUMENTS

DE 102005060882 B3 5/2007
EP 1752730 A2 2/2007

*Primary Examiner* — Bret Hayes
(74) *Attorney, Agent, or Firm* — Baker Hostetler LLP

(57) ABSTRACT

An extensible protection system, comprises a frame that can be deployed around a central tube of longitudinal axis, comprising two ends, a frame covering fabric, the frame having at least two pairs of rigid tubes, two rigid tubes of one pair, in a respective axial plane passing through the longitudinal axis, being articulated by one of their ends to a respective yoke, of which yokes one is secured to one of the ends of the central tube, and the other is secured to the other end of said central tube, the other free ends of the rigid tubes being able to move in the axial plane of the pair, one semirigid tube per pair of rigid tubes, in said axial plane of the pair, comprising at each of its ends a piston, each piston of a semirigid tube being able to slide fluidtightly in each one of the rigid tubes of the pair in order to form a pressurizing chamber in each of the rigid tubes, the protection system further comprising a device for pressurizing the chambers of the rigid tubes in order to cause the pistons to move in the rigid tubes and cause the system to change from a folded position to a deployed position.

10 Claims, 5 Drawing Sheets

(56) References Cited

U.S. PATENT DOCUMENTS

| | | | | | |
|---|---|---|---|---|---|
| 1,463,431 | A | * | 7/1923 | Neft et al. | 160/210 |
| 2,337,165 | A | * | 12/1943 | Olaszy | 114/240 R |
| 2,385,985 | A | * | 10/1945 | Harrison | 114/240 R |
| 2,475,239 | A | * | 7/1949 | Hambrick | 114/240 R |
| 2,490,793 | A | | 12/1949 | Fleming | |
| 3,568,191 | A | | 3/1971 | Hiester et al. | |
| 4,021,974 | A | * | 5/1977 | Edwards | 52/63 |
| 4,262,595 | A | | 4/1981 | Longerich | |
| 4,732,181 | A | * | 3/1988 | Sollander et al. | 141/98 |
| 5,249,527 | A | | 10/1993 | Schwind | |
| 5,576,508 | A | * | 11/1996 | Korpi | 89/36.01 |
| 5,739,458 | A | * | 4/1998 | Girard | 89/36.02 |
| 6,647,855 | B1 | * | 11/2003 | Christiansen et al. | 89/36.01 |
| 2007/0180983 | A1 | * | 8/2007 | Farinella et al. | 89/36.07 |

* cited by examiner

EXTENSIBLE PROTECTION SYSTEM

CROSS-REFERENCE TO RELATED APPLICATIONS

This application is a National Stage of International patent application PCT/EP2010/057756, filed on Jun. 3, 2010, which claims priority to foreign French patent application No. FR 0902732, filed on Jun. 5, 2009, the disclosures of which are incorporated by reference in their entirety.

FIELD OF THE INVENTION

The present invention relates to an extensible protection system that can be used notably in the context of protecting warships.

BACKGROUND

In the particular case of warships, there is the issue of using protection devices that can be deployed very quickly to protect certain parts of the ship against a light threat such as an incoming rocket. The principle of such a protection device consists in deploying, in the path of a detected threat, a device that acts as a shield and that causes the threat to be destroyed or at least reduces its destructive power.

For example, these protection devices of the prior art may be flexible structures that can be inflated using a compressor or gas cylinders. However, such systems have the disadvantage of being of a high cost and of entailing a certain amount of maintenance logistics for transmitting the gases to the inflatable device.

SUMMARY OF THE INVENTION

In order to alleviate the disadvantages of the protection devices of the prior art, the invention proposes a protection system, characterized in that it comprises a frame that can be deployed around a central tube of the frame, of longitudinal axis XX', comprising two ends, a frame covering fabric, the frame comprising:

- at least two pairs of rigid tubes, two rigid tubes of one pair, in a respective axial plane passing through the longitudinal axis XX', being articulated by one of their ends to a respective yoke, of which yokes one is secured to one of the ends of the central tube, and the other is secured to the other end of said central tube, the other free ends of the rigid tubes being able to move in the axial plane of the pair,
- one semirigid tube per pair of rigid tubes, in said axial plane of the pair, comprising at each of its ends a piston, each piston of a semirigid tube being able to slide fluidtightly in each one of the rigid tubes of the pair in order to form a pressurizing chamber in each of the rigid tubes, the protection system further comprising a device for pressurizing the chambers of the rigid tubes in order to cause the pistons to move in the rigid tubes and cause the system to change from a folded position to a deployed position.

Advantageously, the rigid tubes have a degree of freedom in rotation about an axis YY' of articulation to its respective articulating yoke perpendicular to its respective axial plane passing through the axis XX' of the central tube.

In one embodiment, the articulated ends of the rigid tubes are closed in order, with the piston of the semirigid tube, to form the pressurizing chamber in each of the rigid tubes.

In another embodiment, the rigid tube comprises, at its free end, an end stop secured to the rigid tube and in the form of an O-ring seal surrounding the semirigid tube.

In another embodiment, each of the rigid tubes comprises an intermediate guide to guide part of the end of the semirigid tube as it moves in the rigid tube.

In another embodiment, the central tube comprises angle-of-incidence stops arranged at its periphery so that when the system is in the folded position, the free ends of the rigid tubes come to rest against these angle-of-incidence stops to make an angle of incidence θ with the central tube.

In another embodiment, the fabric is configured to adopt an oval shape when the system is in the deployed position, the fabric comprising, at each of the ends of the central tube, an opening through which the rigid tubes can pass, and in that the edges of the openings in the fabric are secured to the rigid tubes in order to hold the fabric in position on the frame.

In another embodiment, the system further comprises cables of predetermined lengths fixed to each of the ends of the central tube in order to give the deployed fabric a predetermined shape.

Key objectives of the invention are to create an extensible protection system that is simple to deploy, reliable and economical.

BRIEF DESCRIPTION OF THE DRAWINGS

The invention will be better understood with the aid of an exemplary embodiment of an extensible protection system according to the invention, with reference to the indexed drawings in which.

DETAILED DESCRIPTION

Figure 1:
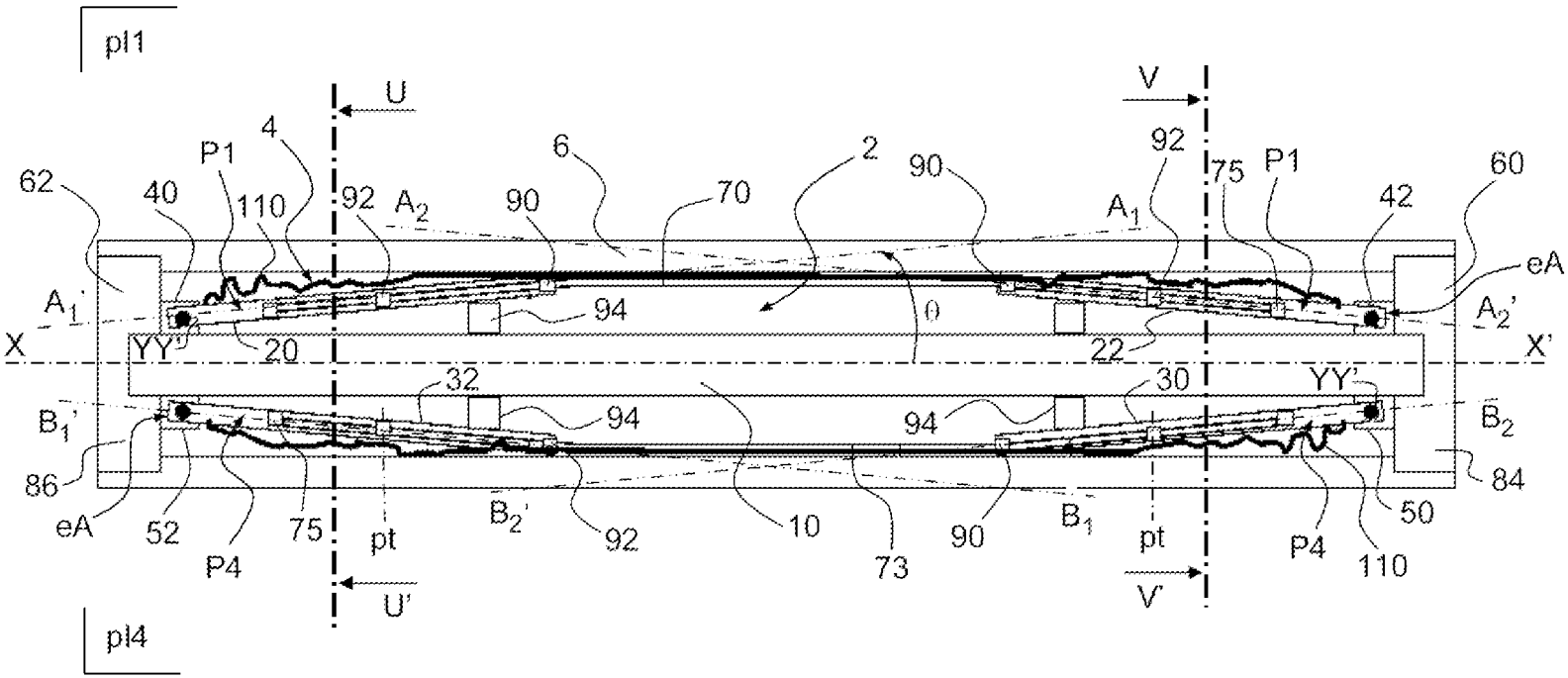
FIG. 1 is a view in a longitudinal section of the extensible protection system according to the invention, in a position in which it is folded up inside a protective cover.

FIG. 1 is a view in longitudinal section of the extensible protection system according to the invention in a position in which it is folded in a protective cover.

Figure 2A:
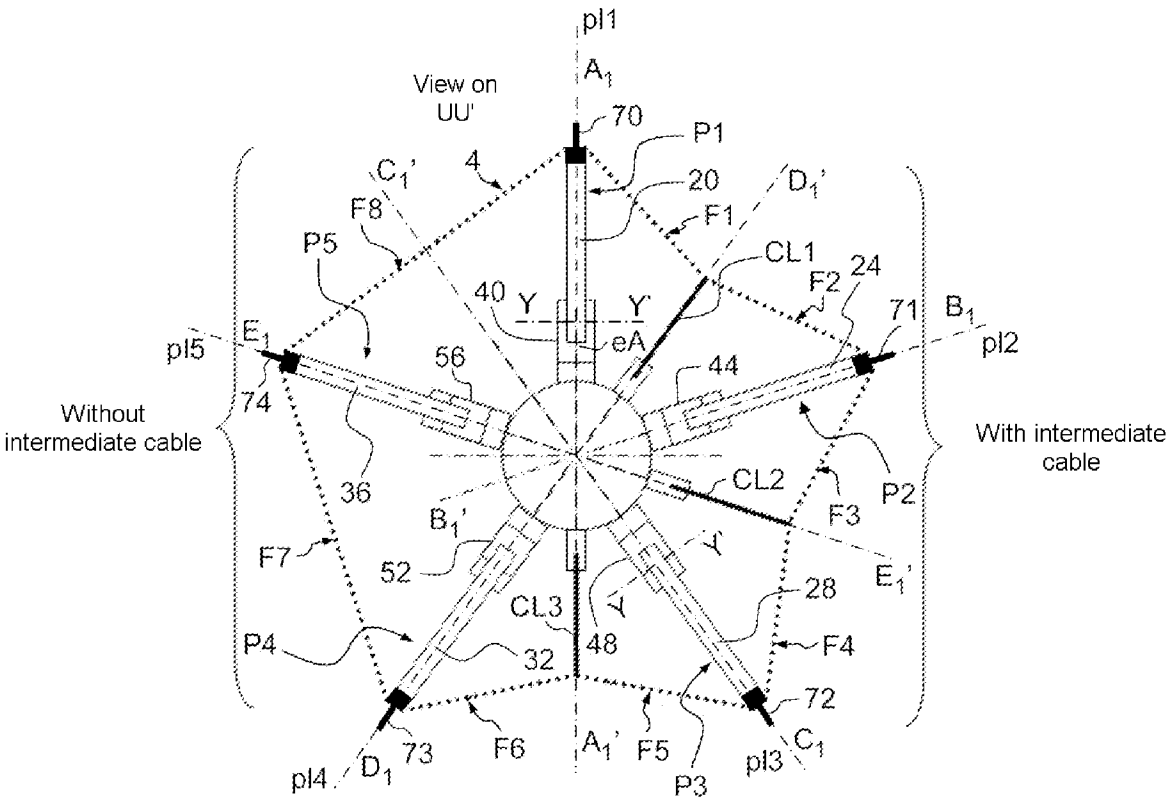
FIGS. 2*a* and 2*b* are two part views, one in one direction and one in the opposite direction, on a longitudinal axis of the system of FIG. 1 in the deployed position.
Figure 2B:
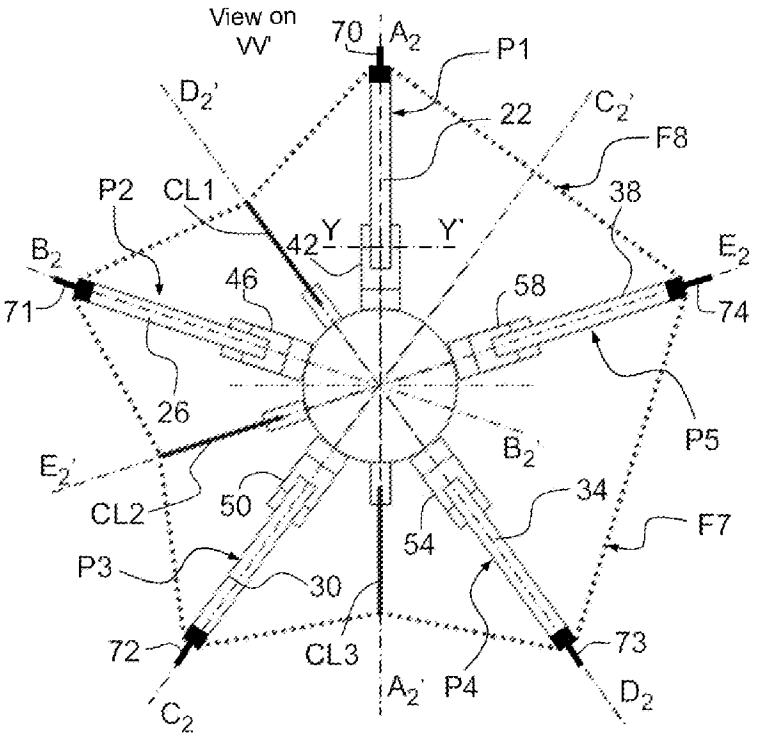

FIGS. 2*a* and 2*b* are two part views one in one direction and one in the opposite direction on a longitudinal axis of the system of FIG. 1 in the deployed position.

The protection system essentially comprises a frame 2 and a covering fabric 4 which is configured to give the deployed system the desired shape around a central tube 10 of the frame, of longitudinal axis XX'.

The system is contained in an external protective cover 6 having its own device to open it prior to deployment of the protection system.

In this exemplary embodiment, the protective cover 6 is of tubular shape about the axis XX'.

FIG. 2*a* is a view on UU' transverse to the axis XX' and FIG. 2*b* is a view on VV' transverse to the same axis XX' (see FIG. 1).

The frame of the protection system of FIGS. 1, 2*a* and 2*b* according to the invention comprises five pairs P1, P2, P3, P4, P5 of rigid tubes angularly distributed about the central tube 10 (see FIGS. 2*a* and 2*b*).

Each pair of rigid tubes, with respective longitudinal axes $A_1A_1'$, $B_1B_1'$, $C_1C_1'$, $D_1D_1$, $E_1E_1'$ in the case of the rigid tubes 20, 24, 28, 32, 36 at one end of the central tube 10, namely the left-hand end in FIG. 1, and $A_2A_2'$, $B_2B_2'$, $C_2C_2'$, $D_2D_2'$, $E_2E_2'$ in the case of the rigid tubes 22, 26, 30, 34, 38 at the other end of said central tube, namely the right-hand end in FIG. 1, are in a respective axial plane p11, p12, p13, p14, p15 passing through the axis XX' of the central tube.

Each of the rigid tubes of a pair is articulated by one of its ends eA, about an axis YY' perpendicular to the axis XX', to a yoke secured to one or other of the ends of the central tube depending on the rigid tube concerned, yokes 40, 44, 48, 52, 56 articulating the rigid tubes 20, 24, 28, 32, 34, 36 to the left-hand end of the central tube and yokes 42, 46, 50, 54, 58 articulating the rigid tubes 22, 26, 30, 34, 38 to the right-hand end of the central tube 10.

The rigid tubes have a degree of freedom in rotation about the axis YY' of articulation to the yoke in the respective axial plane p11, p12, p13, p14, p15 passing through the axis XX' of the central tube. The other free ends of the rigid tubes can therefore move in the respective axial plane p11, p12, p13, p14, p15 of the pair concerned.

A semirigid tube 70, 71, 72, 73, 74 associated with a pair P1, P2, P3, P4, P5 of rigid tubes has a piston 75 at each of its ends.

The two pistons 75 of a semirigid tube fluidtightly seal at their free ends, the rigid tubes facing them belonging to one pair of rigid tubes at each of the ends of the central tube 10 and in one and the same axial plane that passes through the axis XX'.

The articulated ends eA of the rigid tubes, at the yoke end, are closed so as, with the piston 75 in each of the rigid tubes, to form a fluidtight chamber 80 intended to be pressurized.

The piston 75 is intended to be moved longitudinally in the rigid tube by a pressure in the chamber 80 of the rigid tube. To limit the movement of the piston and therefore prevent it from leaving the rigid tube, the free end of the rigid tube has an end stop 90 secured to the rigid tube and closing it at this end. For example, this end stop is in the form of an O-ring seal surrounding the semirigid tube 70, 71, 72, 73, 74.

Each of the rigid tubes further comprises an intermediate guide 92 to guide part of the end of the semirigid tube that is called upon to move in the rigid tube as the system is deployed.

In the position that the system adopts when folded in its protective cover as depicted in FIG. 1, the intermediate guide 92 is immobilized in a predetermined position pt in a central part of the rigid tube between the piston 75 and the end stop 90.

The intermediate guide 92 can be made to effect a translational movement in the rigid tube when a force exceeding a certain threshold value is applied by the piston 75 to the intermediate guide 92 along the longitudinal axis of the rigid tube as the protection system is deployed.

A number of intermediate guides may be positioned in the rigid tubes according to the length of the semirigid tube.

In the folded position of the system as depicted in FIG. 1, in order to prevent the system from jamming as it deploys, an angle of incidence θ formed by the longitudinal axes $A_1A_1'$, $B_1B_1'$, $C_1C_1'$, $D_1D_1'$, $E_1E_1'$ and $A_2A_2'$, $B_2B_2'$, $C_2C_2'$, $D_1D_2'$, $E_2E_2'$ of the rigid tubes and the longitudinal axis XX' of the central tube must not be zero. For this purpose, the central tube 10 comprises angle-of-incidence stops 94 on the periphery of the central tube 10 and arranged on the central tube in such a way that the free ends of the rigid tubes come to rest against these angle-of-incidence stops in order to form said angle of incidence θ.

The system comprises a device for pressurizing the chambers 80 of the rigid tubes (this device is not depicted in the figures) in order to deploy the frame 2 thereof.

In one embodiment, the rigid tubes are closed, at their articulated ends eA, by end plates, a right-hand end plate 84 at one end of the central tube 10 (the right-hand end in FIG. 1) and a left-hand end plate 86 at the other end (the left-hand end in FIG. 1) of the central tube. The chambers 80 of the rigid tubes are pressurized by pressurizing the end plates 84, 86.

In this embodiment, the device for pressurizing the chambers of the rigid tubes comprises a pyrotechnic gas generator in each of the end plates 84, 86 of the frame.

In another embodiment, each rigid tube is closed independently at its articulated end eA. The chambers 80 of each of the rigid tubes are pressurized independently.

The device for pressurizing the chambers of the rigid tubes comprises a pyrotechnic gas generator in each of the chambers 80 of rigid tubes.

In order to pressurize the chambers 80 of the rigid tubes, the system for example comprises an electric device for firing the pyrotechnic gas generators.

The electric device can be controlled by a computer intended to detect the threat and to trigger the deployment of the protection system.

Figure 3A:
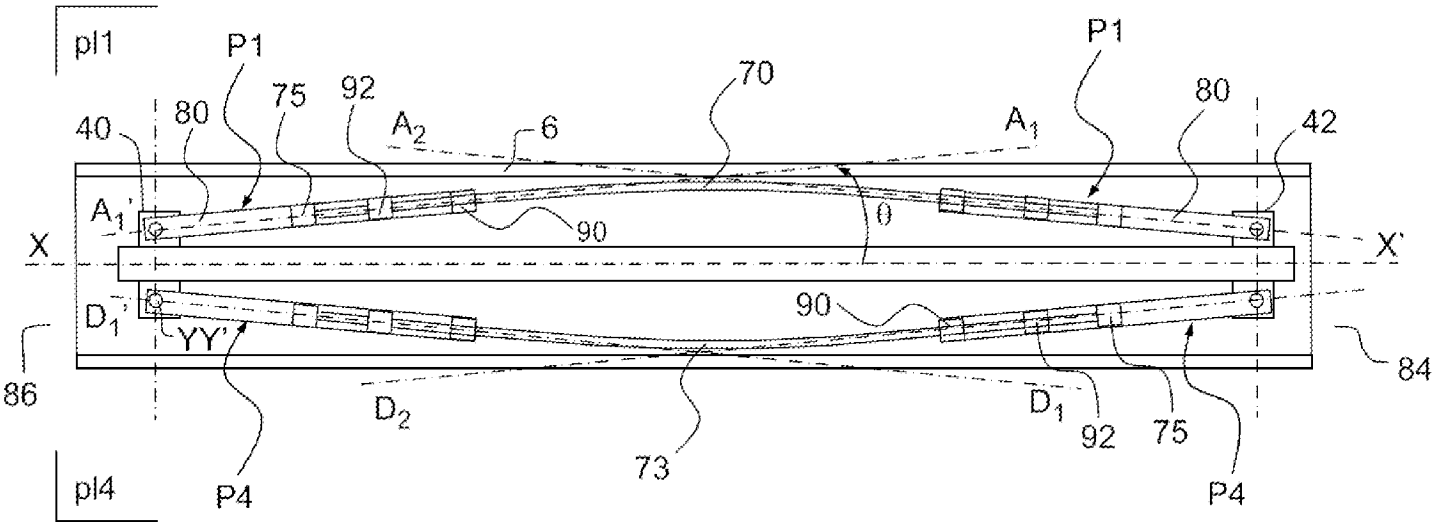
FIG. 3*a* is a schematic view in axial section showing the device according to the invention in the folded position.
Figure 3B:
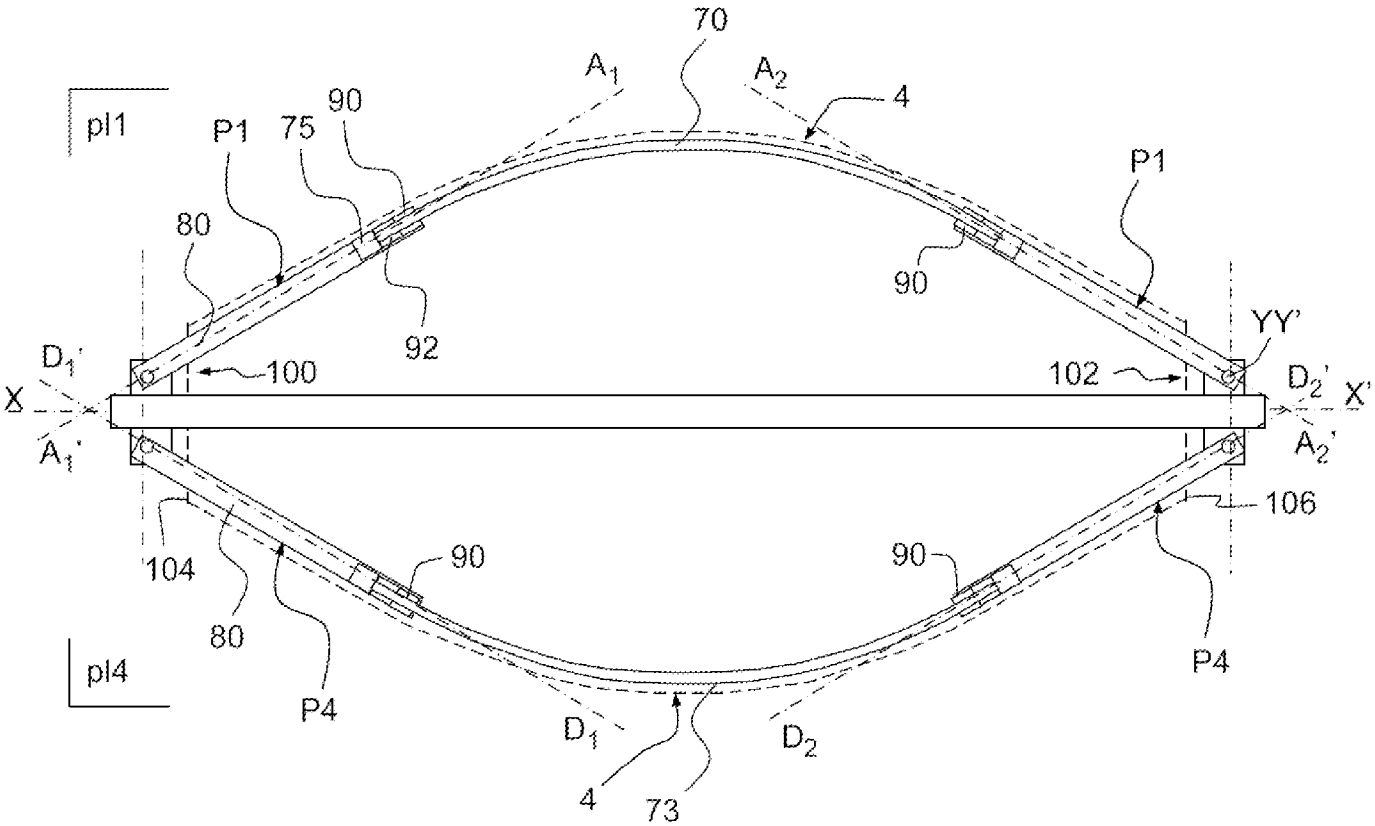
FIG. 3*b* is a schematic view in axial section showing the system according to the invention in the deployed position.

The fabric 4 of the system is configured to adopt an oval shape when the system is deployed (the deployed fabric has been depicted in dotted line in FIGS. 2*a*, 2*b* and 3*b*).

The fabric 4 at each of its ends, on each side of the central tube 10, comprises an opening 100, 102 for the passage of the rigid tubes. The fabric 4 is secured to the rigid and semirigid tubes in order to hold the fabric in position on the frame 2. For example, edges 104, 106 of the openings 100, 102 in the fabric may be secured to the rigid tubes.

When the system is in its folded position, the fabric 4 forms folds 110 so as to fit in the protective cover 6 as depicted in FIG. 1.

In the deployed position (see FIGS. 2*a* and 2*b*) the fabric 4 of the system has facets formed by the pairs of rigid tubes and their associated semirigid tubes, one facet f8 being formed by the consecutive pairs P5 and P1 of rigid tubes and their associated semirigid tubes, another facet f7 being formed by the consecutive pairs P4 and P5 of rigid tubes and their associated semirigid tubes.

The system further comprises cables of predetermined lengths fixed to each of the ends of the central tube 10 to give the deployed fabric a predetermined shape.

For example, in the embodiment shown in FIGS. 2*a* and 2*b*, the system comprises three cables CL1, CL2, CL3 fixed on each end of the central tube 10, each of the cables being fixed between two yokes that are angularly consecutive about the axis XX' in order to form additional facets on the deployed fabric and thus obtain different angles of incidence of the facets of the fabric.

A first cable CL1 fixed on each end of the central tube 10 between the yokes of two angularly consecutive pairs of rigid tubes of axes $A_1A_1'$ and $B_1B_1'$ on one end of the central tube and of axes $A_2A_2'$ and $B_2B_2'$ on the other end of the central tube 10 to form two facets f1 and f2 in that part of the fabric that is contained between the two pairs P1 and P2 of rigid tubes and their associated semirigid tubes.

A second cable CL2 fixed on each end of the central tube 10 between the yokes of two angularly consecutive pairs of rigid tubes of axes $B_1B_1'$ and $C_1C_1'$ on one end of the central tube and of axes $B_2B_2'$ and $C_2C_2'$ on the other end of the central tube 10 to form two facets f3 and f4 in the part of the fabric contained between the two pairs P2 and P3 of rigid tubes and their associated semirigid tubes.

A third cable CL3 fixed on each end of the central tube 10 between the yokes of two angularly consecutive pairs of rigid tubes of axes $C_1C_1'$ and $D_1D_1'$ on one end of the central tube and of axes $C_2C_2'$ and $D_2D_2'$ on the other end of the central tube 10 to form two facets f5 and f6 in the part of the fabric contained between the two pairs P3 and P4 of rigid tubes and their associated semirigid tubes.

The fabric 4 can be made up of several pieces of fabric joined together in order to obtain the oval shape when deployed.

The fabric can be made of flexible and very strong materials such as polyparaphenylene terephthalamide marketed under the trade name of Kevlar.

The protection system further comprises a device for pressurizing the chambers 80 of the rigid tubes in order to cause the pistons 75 to move in the rigid tubes and deploy the frame.

In alternative forms of embodiment of the extensible system, the yokes may include an angular rotation end stop to end the rotation of the rigid tubes following deployment of the frame. Further, the yokes may also include another end stop to achieve the angle of incidence θ of the rigid tubes when the frame is in the folded position, the angle-of-incidence stops 94 on the central tube then no longer being necessary.

The operation of the extensible protection system according to the invention is described hereinafter.

FIG. 3*a* is a schematic view in axial section showing the system according to the invention in the folded position.

FIG. 3*b* is a schematic view in axial section showing the system according to the invention in the deployed position.

When the system is in the folded position of FIG. 3*a*, the protection system is enclosed inside the protective case 6 of small cross section with the closure end plates 84, 86 at each of its ends.

Upon actuation of the protection system, the protective case 6 opens to allow the frame and the protective fabric to be deployed as described hereinabove.

As specified previously, in the state of rest (when the system is folded) the longitudinal axes of the rigid tubes of the frame 4 form with the axis XX' of the central tube 10 a small but never zero angle of incidence θ so that as the frame begins to deploy the developed shape that the system is to adopt is encouraged. When the system is in the folded position, the rigid tubes rest via their free ends against the angle-of-incidence stops 94.

The value chosen for this angle of incidence θ depends on the lengths of the rigid and semirigid tubes.

Let us consider the pressurizing of the chamber 80 of each of the rigid tubes 20, 24, 28, 32, 36 at one end and 22, 26, 30, 34, 38 at the other end of the central tube 10 using a pyrotechnic capsule housing the chamber 80 of each of the rigid tubes. An electrical device (not depicted in the figures) can be used to activate the pyrotechnic capsules in the rigid tubes.

At the moment of deployment, which has to be very rapid in order for the system to afford effective protection, the pyrotechnic gas capsules are activated, pressurizing the chambers 80 of the rigid tubes. The pistons 75 of the semirigid tubes 70, 71, 72, 73, 74 are therefore driven toward the free ends of the rigid tubes which, via said pistons, are subjected to forces transverse to the axis XX' in the respective planes p11, p12, p13, p14, p15 of the pairs P1, P2, P3, P4, P5 of rigid tubes, causing the articulated ends of the rigid tubes to articulate away from the central tube 10. Each of the semirigid tubes 70, 71, 72, 73, 74 thus moving away from the central tube driven by its pistons adopts the shape of an arc which shape is altered by the presence of the fabric 4 that these tubes carry with them in their movement.

The commands to increase the pressure in the chambers 80 are not necessarily all simultaneous. A phased timing is acceptable.

FIG. 2*b* is a simplified schematic cross section with the system in the deployed position, showing the pairs P1 and P4 of rigid tubes and their associated semirigid tubes 70, 73 in the respective axial planes p11, p14.

The pistons 75 of the semirigid tubes driven by the pressurized gases in the chambers 80 of the rigid tubes move along the rigid tubes, carrying with them in their movement the intermediate guides 92 as far as the end stops 90, thus limiting the deployment of the frame 2.

The length of the arc formed by two rigid tubes of a pair and its respective associated semirigid tube increases at the moment of deployment of the system, this having the effect of deploying the fabric which then adopts its oval shape.

The frame 2 with the cables CL1, CL2, CL3 alters the exterior shape of the fabric 4 to form the facets f1 to f8 in an overall oval shape.

The described example of a protection system according to the invention is nonlimiting and the frame may have a greater or smaller number of pairs of rigid tubes and associated semirigid tubes (for example may have between 4 and 6 pairs) and a variable number of intermediate cables in order to obtain the desired shape for the unfolded fabric.

The protection system according to the invention has the advantage of being simpler to deploy, more reliable, less expensive and easier to maintain than the systems of the prior art that involve inflating a fluidtight protective fabric.

The invention claimed is:

1. An extensible protection system, comprising a frame deployed around a central tube having a longitudinal axis XX' and comprising two ends, and a frame covering fabric, the frame further comprising:

at least two pairs of rigid tubes, two rigid tubes in each pair, in a respective axial plane passing through the longitudinal axis XX', being articulated by one of their ends to a respective yoke, of which yokes one is secured to one of the ends of the central tube, and the other is secured to the other end of said central tube, the other free ends of the rigid tubes being able to move in the axial plane of the pair, and one semirigid tube per pair of rigid tubes, in said axial plane of the pair, comprising at each of its ends a piston, each piston of a semirigid tube being able to slide fluidtightly in each one of the rigid tubes of the pair in order to form a pressurizing chamber in each of the rigid tubes, wherein the pressurizing chambers of the rigid tubes are configured to be pressurized to cause the pistons to move in the rigid tubes and to cause the protection system to change from a folded position to a deployed position.

2. The protection system as claimed in claim 1, wherein the rigid tubes have a degree of freedom in rotation about an axis YY' of articulation to its respective articulating yoke perpendicular to its respective axial plane passing through the axis XX' of the central tube.

3. The protection system as claimed in claim 1, wherein the articulated ends of the rigid tubes are closed in order, with the piston of the semirigid tube, to form the pressurizing chamber in each of the rigid tubes.

4. The protection system as claimed in claim 1, wherein each of the rigid tubes comprises, at its free end, an end stop secured to the rigid tube and in the form of an O-ring seal surrounding the semirigid tube.

5. The protection system as claimed in claim 1 wherein each of the rigid tubes comprises an intermediate guide to guide part of an end of a semirigid tube as the semirigid tube moves in a rigid tube.

6. The protection system as claimed in claim 1, wherein the central tube comprises angle-of-incidence stops arranged at its periphery so that when the protection system is in the folded position, the free ends of the rigid tubes come to rest against these angle-of-incidence stops to make an angle of incidence θ with the central tube.

7. The protection system as claimed in claim 1, wherein the fabric is configured to adopt an oval shape when the protection system is in the deployed position, the fabric comprising, at each of the ends of the central tube, an opening through which the rigid tubes can pass, and wherein edges of the openings in the fabric are secured to the rigid tubes in order to hold the fabric in position on the frame.

8. The protection system as claimed in claim 1, wherein the protection system further comprises cables of predetermined lengths fixed to each of the ends of the central tube in order to give the fabric a predetermined shape.

9. The protection system as claimed in claim 1, wherein, at their articulated ends, the rigid tubes are closed by end plates, a right-hand end plate at one end of the central tube and a left-hand end plate at the other end of the central tube, the chambers of the rigid tubes being pressurized by pressurizing the end plates.

10. The protection system as claimed in claim 1, wherein each of the rigid tubes is closed independently at its articulated end, the chambers of each of the rigid tubes being pressurized independently.

* * * * *